US006905309B2

(12) United States Patent
Nussbaum et al.

(10) Patent No.: US 6,905,309 B2
(45) Date of Patent: Jun. 14, 2005

(54) METHODS AND APPARATUS FOR REDUCING VIBRATIONS INDUCED TO COMPRESSOR AIRFOILS

(75) Inventors: Jeffrey Howard Nussbaum, Wilmington, MA (US); Xin Wei, Swampscott, MA (US); Tara Chaidez, Malden, MA (US); Michael Macrorie, Winchester, MA (US)

(73) Assignee: General Electric Company, Schenectady, NY (US)

( * ) Notice: Subject to any disclaimer, the term of this patent is extended or adjusted under 35 U.S.C. 154(b) by 35 days.

(21) Appl. No.: 10/650,288

(22) Filed: Aug. 28, 2003

(65) Prior Publication Data

US 2005/0047919 A1 Mar. 3, 2005

(51) Int. Cl.[7] ..... F01D 1/00
(52) U.S. Cl. ..... 415/223 A; 415/144; 29/889.1
(58) Field of Search ..... 415/235–236 R, 415/144–145, 181, 119, DIG. 1; 416/500; 29/889.1, 402.08, 889.21–889.22

(56) References Cited

U.S. PATENT DOCUMENTS 2,920,864 A * 1/1960 Lee ..... 416/196 R
3,012,709 A * 12/1961 Schnell ..... 416/236 R
3,193,185 A * 7/1965 Erwin et al. ..... 415/193
3,412,611 A * 11/1968 Whitaker et al. ..... 72/377
3,653,110 A * 4/1972 King et al. ..... 29/889.72
3,706,512 A * 12/1972 Strelshik ..... 416/236 R
3,758,231 A * 9/1973 Barnstead ..... 416/132 R
4,012,165 A * 3/1977 Kraig ..... 415/145
4,108,573 A * 8/1978 Wagner ..... 416/236 A
4,589,824 A 5/1986 Kozlin
4,720,239 A * 1/1988 Owczarek ..... 415/181
5,261,789 A 11/1993 Butts et al.
5,269,057 A * 12/1993 Mendham ..... 29/889.1
6,164,914 A 12/2000 Correia et al.
6,179,556 B1 1/2001 Bunker
6,299,412 B1 10/2001 Wood et al.
6,382,913 B1 5/2002 Lee et al.
6,503,053 B2 * 1/2003 Huebner ..... 415/191
6,524,070 B1 * 2/2003 Carter ..... 416/193 A

* cited by examiner

*Primary Examiner*—Edward K. Look
*Assistant Examiner*—James M. McAleenan
(74) *Attorney, Agent, or Firm*—William Scott Andes; Armstrong Teasdale LLP

(57) ABSTRACT

A method enables a rotor blade for a gas turbine engine to be fabricated. The method comprises forming an airfoil including a first side wall and a second side wall that each extend in radial span between an airfoil root and an airfoil tip, and wherein the first and second side walls are connected at a leading edge and at a trailing edge, and forming a winglet that extends outwardly from at least one of the airfoil first side wall and the airfoil second side wall, such that a radius extends between the winglet and at least one of the airfoil first side wall and the second side wall.

18 Claims, 4 Drawing Sheets

METHODS AND APPARATUS FOR REDUCING VIBRATIONS INDUCED TO COMPRESSOR AIRFOILS

BACKGROUND OF THE INVENTION

This application relates generally to gas turbine engine rotor blades and, more particularly, to methods and apparatus for reducing vibrations induced to rotor blades.

Gas turbine engine rotor blades typically include airfoils having leading and trailing edges, a pressure side, and a suction side. The pressure and suction sides connect at the airfoil leading and trailing edges, and span radially between the airfoil root and the tip. An inner flowpath is defined at least partially by the airfoil root, and an outer flowpath is defined at least partially by a stationary casing. For example, at least some known compressors include a plurality of rows of rotor blades that extend radially outwardly from a disk or spool.

Known compressor rotor blades are cantilevered adjacent to the inner flowpath such that a root area of each blade is thicker than a tip area of the blades. More specifically, because the tip areas are thinner than the root areas, and because the tip areas are generally mechanically unrestrained, during operation wake pressure distributions may induce chordwise bending or other vibration modes into the blade through the tip areas. In addition, vibrational energy may also be induced into the blades by a resonance frequency present during engine operation. Continued operation with chordwise bending or other vibration modes may limit the useful life of the blades.

To facilitate reducing tip vibration modes, and/or to reduce the effects of a resonance frequency present during engine operations, at least some known vanes are fabricated with thicker tip areas. However, increasing the blade thickness may adversely affect aerodynamic performance and/or induce additional radial loading into the rotor assembly. Accordingly, other known blades are fabricated with a shorter chordwise length in comparison to other known blades. However, reducing the chord length of the blade may also adversely affect aerodynamic performance of the blades.

BRIEF SUMMARY OF THE INVENTION

In one aspect a method for fabricating a rotor blade for a gas turbine engine is provided. The method comprises forming an airfoil including a first side wall and a second side wall that each extend in radial span between an airfoil root and an airfoil tip, and wherein the first and second side walls are connected at a leading edge and at a trailing edge, and forming a winglet that extends outwardly from at least one of the airfoil first side wall and the airfoil second side wall, such that a radius extends between the winglet and at least one of the airfoil first side wall and the second side wall.

In another aspect, an airfoil for a gas turbine engine is provided. The airfoil includes a leading edge, a trailing edge, a tip, a first side wall that extends in radial span between an airfoil root and the tip, wherein the first side wall defines a first side of said airfoil, and a second side wall connected to the first side wall at the leading edge and the trailing edge, wherein the second side wall extends in radial span between the airfoil root and the tip, such that the second side wall defines a second side of the airfoil. The airfoil also includes a winglet extending outwardly from at least one of said first side wall and said second side wall such that a radius extends between said winglet and at least least one of said first and second side walls.

In a further aspect, a gas turbine engine including a plurality of rotor blades is provided. Each rotor blade includes an airfoil having a leading edge, a trailing edge, a first side wall, a second side wall, and at least one winglet that extends outwardly from at least one of the first side wall and the second side wall such that a radius is formed between the winglet and at one of said first and second side walls. The airfoil first and second side walls are connected axially at the leading and trailing edges, and the first and second side walls also extend radially from a blade root to an airfoil tip.

DETAILED DESCRIPTION OF THE INVENTION

Figure 1:
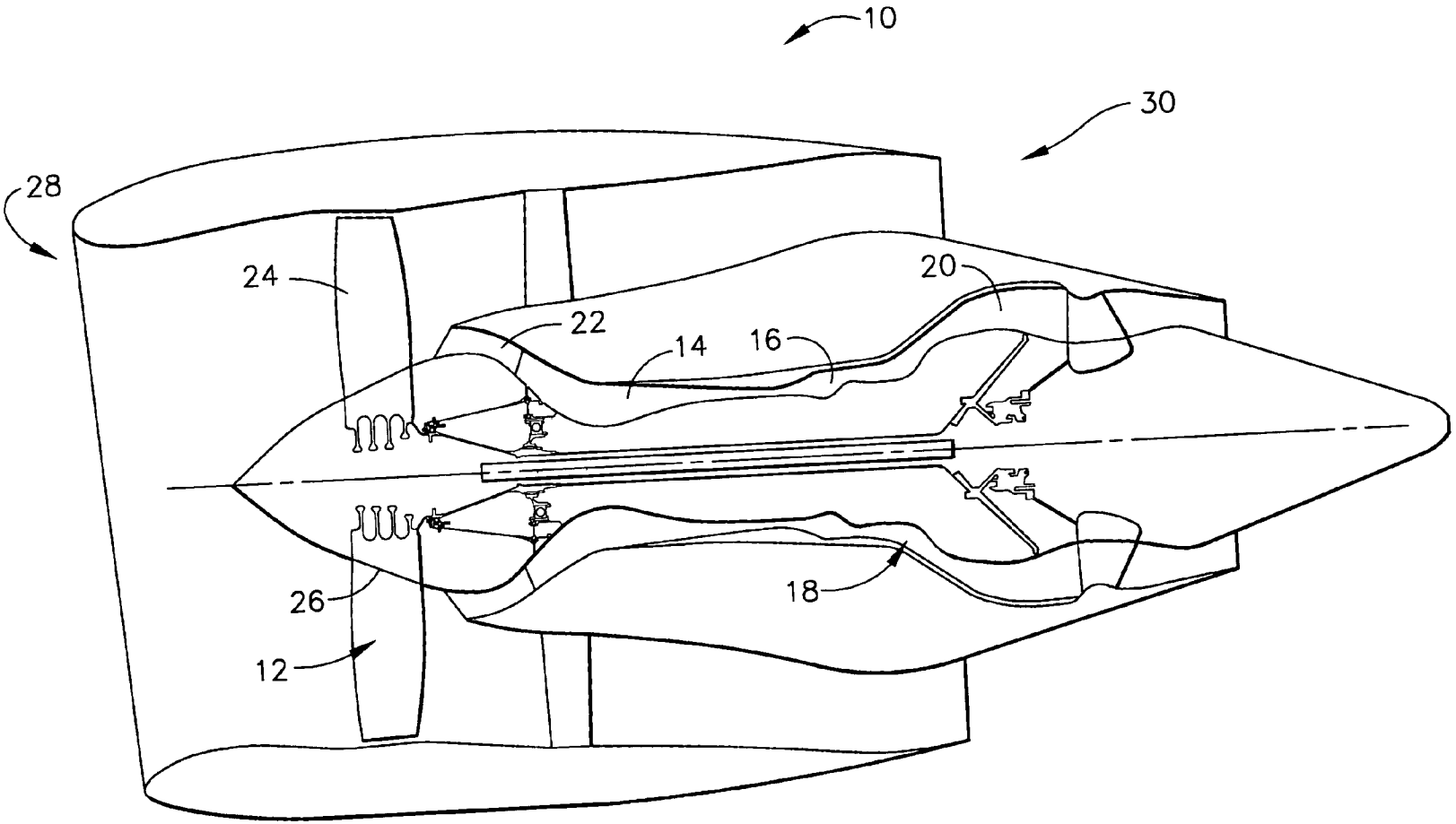
FIG. 1 is schematic illustration of a gas turbine engine.

FIG. 1 is a schematic illustration of a gas turbine engine 10 including a fan assembly 12, a high pressure compressor 14, and a combustor 16. Engine 10 also includes a high pressure turbine 18, a low pressure turbine 20, and a booster 22. Fan assembly 12 includes an array of fan blades 24 extending radially outward from a rotor disc 26. Engine 10 has an intake side 28 and an exhaust side 30. In one embodiment, the gas turbine engine is a GE90 available from General Electric Company, Cincinnati, Ohio.

In operation, air flows through fan assembly 12 and compressed air is supplied to high pressure compressor 14. The highly compressed air is delivered to combustor 16. Airflow (not shown in FIG. 1) from combustor 16 drives turbines 18 and 20, and turbine 20 drives fan assembly 12.

Figure 2:
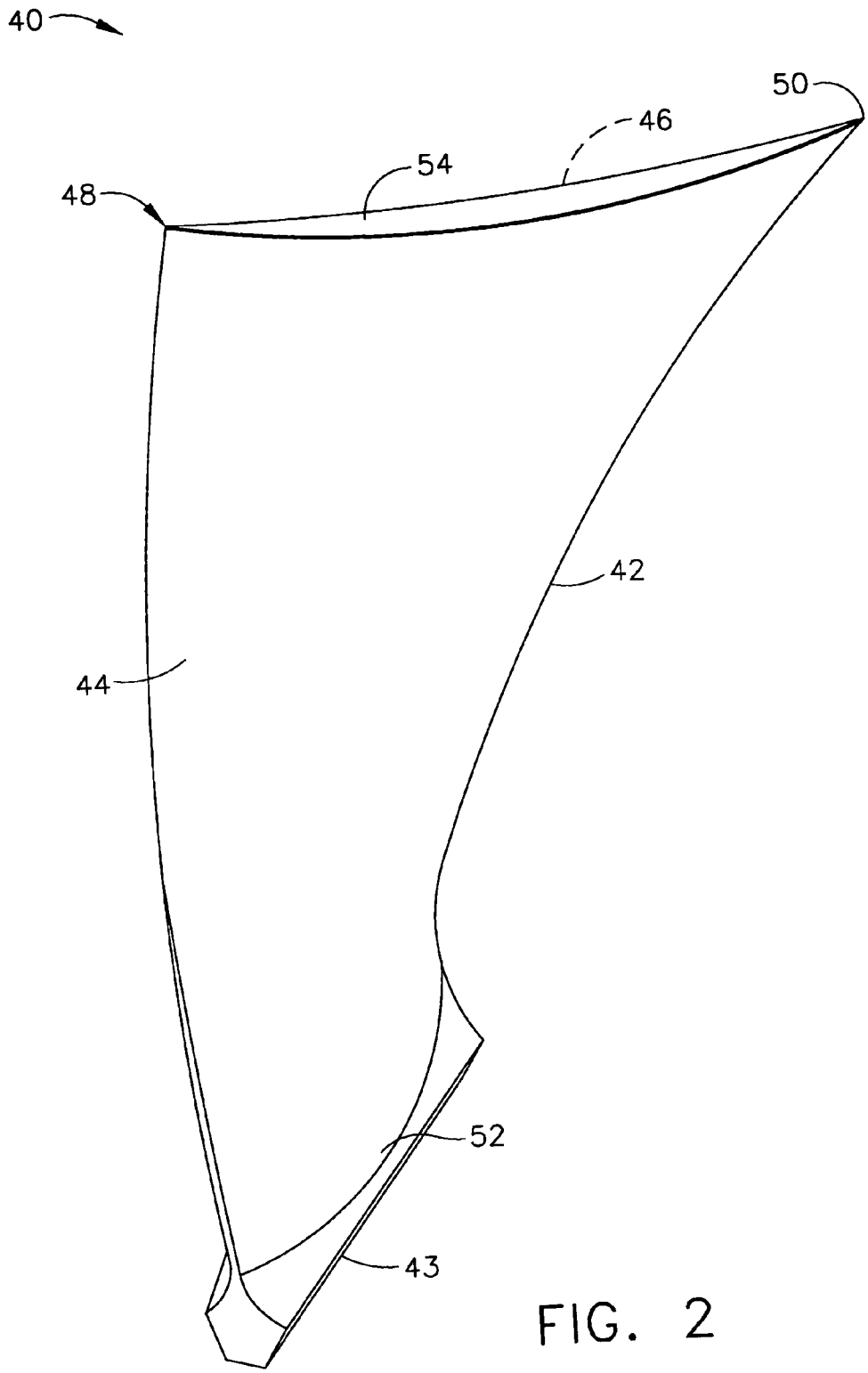
FIG. 2 is a perspective view of a rotor blade that may be used with the gas turbine engine shown in FIG. 1.
Figure 3:
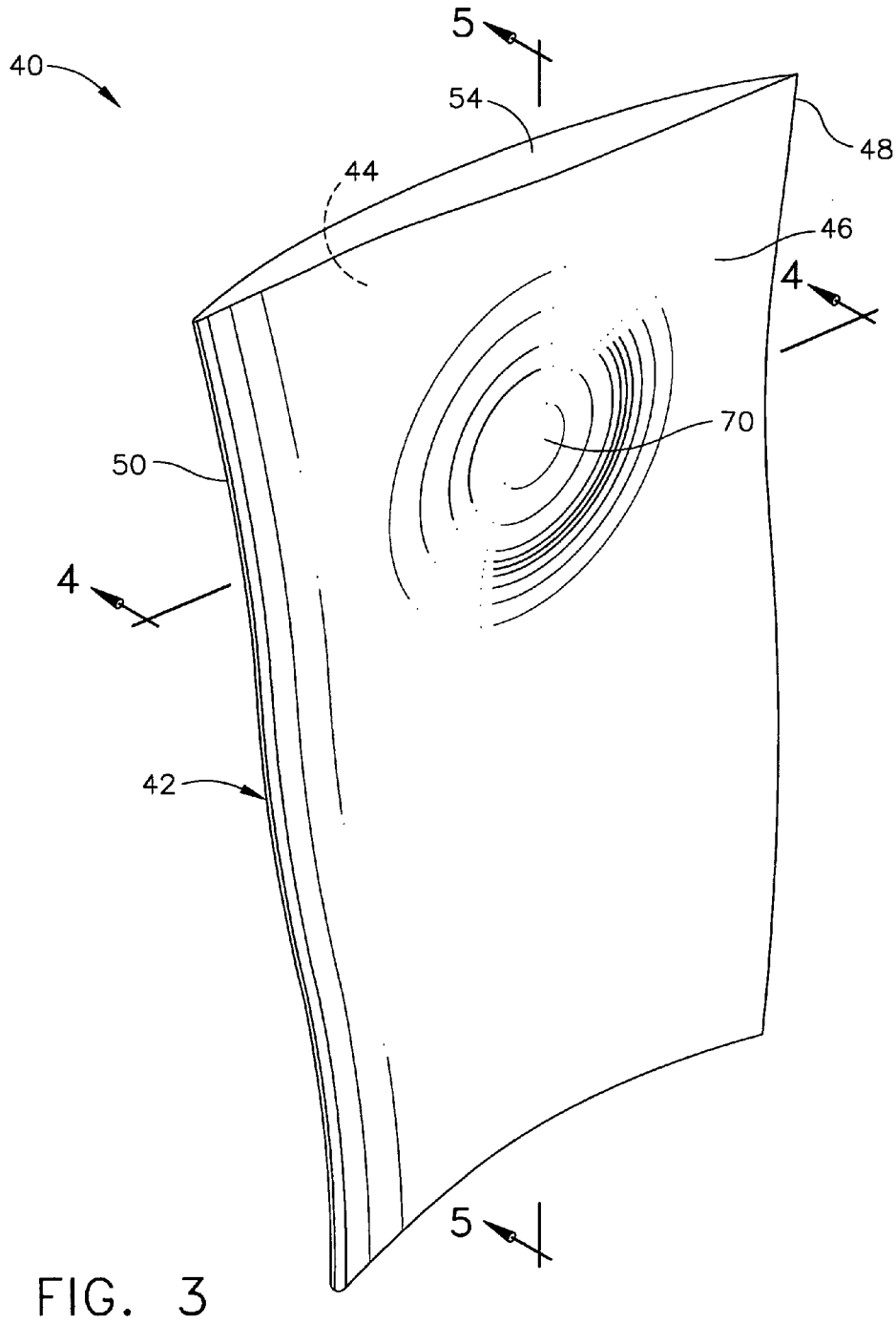
FIG. 3 is a partial perspective view of the rotor blade shown in FIG. 2, and viewed from an opposite side of the rotor blade.
Figure 4:
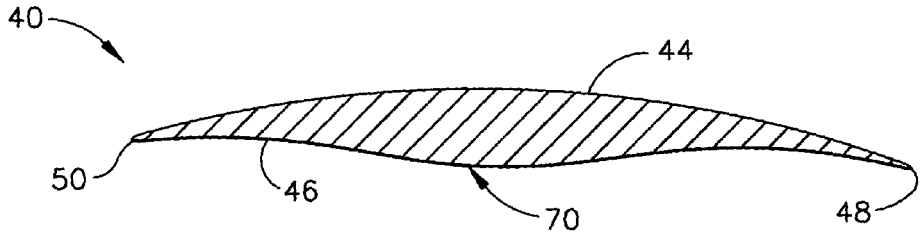
FIG. 4 is a cross-sectional view of the rotor blade shown in FIG. 3 and taken along line 4—4.
Figure 5:
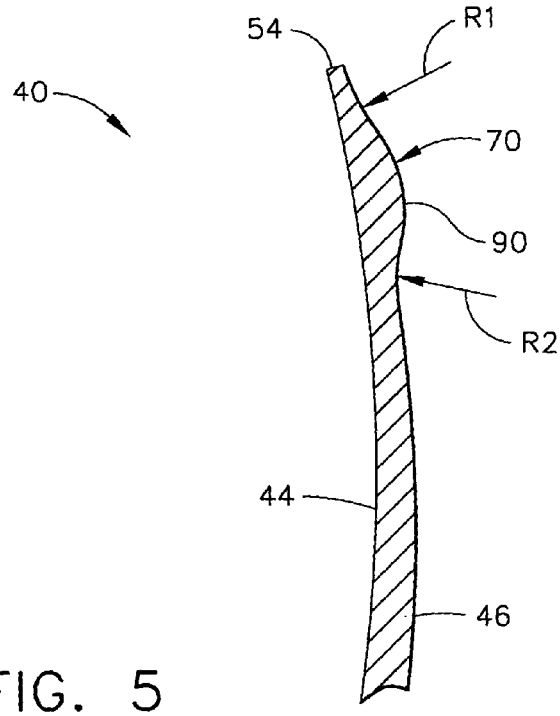
FIG. 5 is a cross-sectional view of the rotor blade shown in FIG. 3 and taken along line 5—5.

FIG. 2 is a partial perspective view of a rotor blade 40 that may be used with a gas turbine engine, such as gas turbine engine 10 (shown in FIG. 1). FIG. 3 is a partial perspective view of rotor blade 40 viewed from an opposite side of rotor blade 40. FIG. 4 is a cross-sectional view of rotor blade 40 taken along line 4—4. FIG. 5 is a cross-sectional view of rotor blade 40 taken along line 5—5. In one embodiment, a plurality of rotor blades 40 form a high pressure compressor stage (not shown) of gas turbine engine 10. Each rotor blade 40 includes an airfoil 42 and an integral dovetail 43 used for mounting airfoil 42 to a rotor disk (not shown) in a known manner. Alternatively, blades 40 may extend radially outwardly from a disk (not shown), such that a plurality of blades 40 form a blisk (not shown).

Each airfoil 42 includes a first contoured side wall 44 and a second contoured side wall 46. First side wall 44 is convex and defines a suction side of airfoil 42, and second side wall 46 is concave and defines a pressure side of airfoil 42. Side walls 44 and 46 are joined at a leading edge 48 and at an axially-spaced trailing edge 50 of airfoil 42. More specifically, airfoil trailing edge 50 is spaced chordwise and downstream from airfoil leading edge 48. First and second side walls 44 and 46, respectively, extend longitudinally or radially outward in span from a blade root 52 positioned adjacent dovetail 43, to an airfoil tip 54.

A winglet 70 extends outwardly from second side wall 46. In an alternative embodiment winglet 70 extends outwardly from first side wall 44. In a further alternative embodiment, a first winglet extends outwardly from second side wall 46 and a second winglet extends outwardly from first side wall 44. Accordingly, winglet 70 is contoured to conform to side wall 46 and as such follows airflow streamlines extending across side wall 46. In the exemplary embodiment, winglet 70 extends in a chordwise direction substantially across side wall 46, such that winglet 70 is substantially flush with side wall 46 adjacent leading edge 48 and adjacent trailing edge 50. Alternatively, the winglet is aligned in a non-chordwise direction with respect to side wall 46. More specifically, in the exemplary embodiment, winglet 70 extends chordwise substantially between airfoil leading and trailing edges 48 and 50, respectively. Alternatively, the winglet extends to only one of airfoil leading or trailing edges 48 and 50, respectively. In a further alternative embodiment, winglet 70 extends only partially along side wall 46 between airfoil leading and trailing edges 48 and 50, respectively, and does not extend to either leading or trailing edges 48 and 50, respectively.

Winglet 70 has a non-rectangular cross-sectional profile and is aerodynamically-shaped with respect to side wall 46 such that a first radius $R_1$ and a second radius $R_2$ extend between winglet 70 and side wall 46. In the exemplary embodiment, winglet 70 also includes an arcuate outer surface 90 that extends between first radius $R_1$ and a second radius $R_2$. More specifically, first radius $R_1$ extends along winglet 70 to provide a smooth transition between winglet 70 and airfoil tip 54, and second radius $R_2$ extends along winglet 70 to provide a smooth transition between winglet 70 and root 52. In the exemplary embodiment, first radius $R_1$ is larger than second radius $R_2$. A geometric configuration of winglet 70, including a relative position, size, and length of winglet 70 with respect to blade 40, can vary and is selected based on operating and performance characteristics of blade 40.

Winglet 70 facilitates stiffening airfoil 42 such that a natural frequency of vibration of airfoil 42 is increased to a frequency that is not present within gas turbine engine 10 during normal engine operations. Accordingly, modes of vibration that may be induced into similar airfoils that do not include a winglet 70, are facilitated to be substantially eliminated by winglet 70. More specifically, winglet 70 enables a provides a technique for tuning chordwise mode frequencies out of the normal engine operating speed, such that a desired frequency margin may be achieved. In addition, winglet 70 also facilitates strengthening blade 40 without providing frequency margin.

Moreover, during assembly of airfoil 42, the cross-sectional shape of winglet 70 enables winglet 70 to be formed integrally with airfoil 42 with reduced manufacturing costs compared to other geometric shapes. Specifically, the combination of winglet first radius $R_1$, second radius $R_2$, and arcuate outer surface 90, enable winglet 70 to be formed using an eletro-chemical machining (ECM) process with a radial electrolyte flow. More specifically, the smooth transition formed by each radius $R_1$ and $R_2$ between winglet 70 and airfoil 42 facilitates the ECM electrode flowing smoothly and continuously over winglet 70 without cavitation or flow disruption. The ECM process facilitates blade 40 being manufactured with reduced costs and time in comparison to other known blade manufacturing methods.

Energy induced to airfoil 42 is calculated as the dot product of the force of the exciting energy and the displacement of airfoil 42. More specifically, during operation, aerodynamic driving forces, i.e., wake pressure distributions, are generally the highest adjacent airfoil tip 54 because tip 54 is generally not mechanically constrained. However, winglet 70 stiffens and increases a local thickness of airfoil 42, such that the displacement of airfoil 42 is reduced in comparison to similar airfoils that do not include winglet 70. Accordingly, because winglet 70 increases a frequency of airfoil 42 and reduces an amount of energy that is induced to airfoil 42, airfoil 42 receives less aerodynamic excitation and less harmonic input from wake pressure distributions. In addition, because winglet 70 is positioned radial distance 102 from tip 54, rib 70 will not contact the stationary shroud. Furthermore, because first radius $R_1$ is larger than second radius $R_2$, first radius $R_1$ facilitates reducing stress concentrations between winglet 70 and airfoil 42, thus improving the strength and useful life of blade 40.

Figure 6:
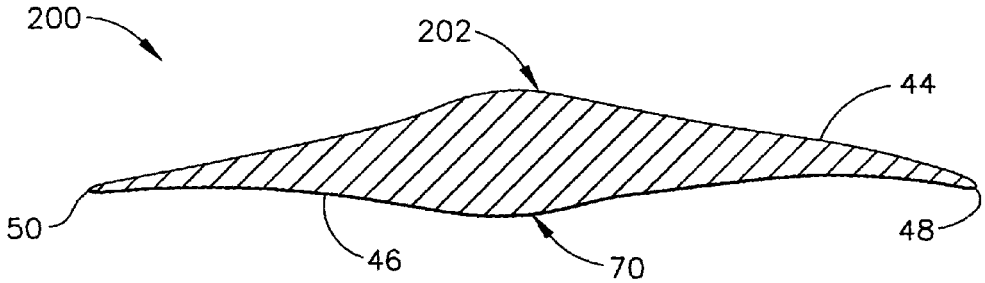
FIG. 6 is a cross-sectional view of an alternative embodiment of a rotor blade that may be used with the gas turbine engine shown in FIG. 1.

FIG. 6 is a cross-sectional view of an alternative embodiment of a rotor blade 200 that may be used with gas turbine engine 10 (shown in FIG. 1). Rotor blade 200 is substantially similar to rotor blade 40 (shown in FIGS. 2–5) and components in rotor blade 200 that are identical to components of rotor blade 40 are identified in FIG. 6 using the same reference numerals used in FIGS. 2–5. Specifically, in one embodiment, rotor blade 200 is identical to rotor blade 40 with the exception that rotor blade 200 includes a second winglet 202 in addition to winglet 70. More specifically, in the exemplary embodiment, winglet 202 is identical to rib 70 but extends across side wall 44 rather than side wall 46.

Winglet 202 extends outwardly from first side wall 44 and is contoured to conform to side wall 44, and as such, follows airflow streamlines extending across side wall 44. In the exemplary embodiment, winglet 202 extends in a chordwise direction substantially across side wall 44, such that winglet 202 is substantially flush with side wall 44 adjacent leading edge 48 and adjacent trailing edge 50. Alternatively, winglet 202 is aligned in a non-chordwise direction with respect to side wall 46. More specifically, in the exemplary embodiment, winglet 202 extends chordwise substantially between airfoil leading and trailing edges 48 and 50, respectively. Alternatively, winglet 202 extends to only one of airfoil leading or trailing edges 48 and 50, respectively. In a further alternative embodiment, winglet 202 extends only partially along side wall 46 between airfoil leading and trailing edges 48 and 50, respectively, and does not extend to either leading or trailing edges 48 and 50, respectively.

A geometric configuration of winglet 202, including a relative position, size, and length of winglet 202 with respect to blade 40, is variably selected based on operating and performance characteristics of blade 40. In one embodiment, winglet 202 is positioned radial distance 102 from airfoil tip 54, and as such is substantially radially aligned with winglet 70. In another embodiment, winglet 202 is not radially aligned with respect to winglet 70.

The above-described rotor blade is cost-effective and highly reliable. The rotor blade includes a winglet that extends outwardly from at least one of the airfoil surfaces. The winglet facilitates tuning chordwise mode frequencies of the blade out of the normal engine operating speed range. Furthermore, the stiffness of the winglet facilitates decreasing an amount of energy induced to each respective airfoil. Moreover, the winglet facilitates improving performance of the airfoil relative to an airfoil having substantially less tip chord. As a result, a winglet is provided that facilitates maintaining aerodynamic performance of a blade, while providing aeromechanical stability to the blade, in a cost effective and reliable manner.

Exemplary embodiments of blade assemblies are described above in detail. The blade assemblies are not limited to the specific embodiments described herein, but rather, components of each assembly may be utilized independently and separately from other components described herein. Each rotor blade component can also be used in combination with other rotor blade components.

While the invention has been described in terms of various specific embodiments, those skilled in the art will recognize that the invention can be practiced with modification within the spirit and scope of the claims.

What is claimed is:

1. A method for fabricating a rotor blade for a gas turbine engine, said method comprising:

forming an airfoil including a first side wall and a second side wall that each extend in radial span between an airfoil root and an airfoil tip, and wherein the first and second side walls are connected at a leading edge and at a trailing edge; and forming a winglet that is positioned a distance from the leading edge and trailing edge and extends outwardly from at least one of the airfoil first side wall and the airfoil second side wall and positioned a radial distance from the airfoil tip, such that a radius extends between the winglet and at least one of the airfoil first side wall and the second side wall.

2. A method in accordance with claim 1 wherein forming a winglet that extends outwardly from at least one of the airfoil first side wall and the airfoil second side wall comprises forming a first winglet that extends outwardly from the airfoil first side wall and is positioned a first radial distance from the airfoil tip; and forming a second winglet that extends outwardly from the airfoil second side wall and is positioned a second radial distance from the airfoil tip.

3. A method in accordance with claim 1 wherein forming a winglet that extends outwardly from at least one of the airfoil first side wall and the airfoil second side wall comprises: forming the winglet to structurally support the airfoil such that a natural frequency of chordwise vibration of the airfoil is increased to a frequency that is not present within the gas turbine engine during engine operations.

4. A method in accordance with claim 1 wherein forming a winglet that extends outwardly from at least one of the airfoil first side wall and the airfoil second side wall comprises forming the winglet using an electro-chemical machining process.

5. A method in accordance with claim 1 wherein forming a winglet that extends outwardly from at least one of the airfoil first side wall and the airfoil second side wall comprises forming the winglet to have a substantially non-rectangular cross-sectional profile.

6. An airfoil for a gas turbine engine, said airfoil comprising:

a leading edge;

a trailing edge;

a tip;

a first side wall extending in radial span between an airfoil root and said tip, said first side wall defining a first side of said airfoil;

a second side wall connected to said first side wall at said leading edge and said trailing edge, said second side wall extending in radial span between the airfoil root and said tip, said second side wall defining a second side of said airfoil; and a winglet positioned a distance from the leading edge and trailing edge and extending outwardly from at least one of said first side wall and said second side wall such that a radius extends between said winglet and at least one of said first and second side walls, said winglet is a radial distance from said airfoil tip.

7. An airfoil in accordance with claim 6 wherein at least one of said airfoil first side wall and said second side wall is concave, said remaining side wall is convex, said winglet is substantially flush with at least one of said first and second side walls at said airfoil leading edge.

8. An airfoil in accordance with claim 6 wherein at least one of said airfoil first side wall and said second side wall is concave, said remaining side wall is convex, said winglet is substantially flush with at least one of said first and second side walls at said airfoil trailing edge.

9. An airfoil in accordance with claim 6 wherein said winglet is further configured to provide structural support to said airfoil such that a such that a natural frequency of torsional or chordwise vibration of said airfoil is increased to a frequency that is not present within the gas turbine engine during engine operations.

10. An airfoil in accordance with claim 6 wherein, said winglet comprises a non-rectangular cross-sectional profile.

11. An airfoil in accordance with claim 6 wherein a first winglet extends outwardly from said first side wall, and a second winglet extends outwardly from said second side wall.

12. An airfoil in accordance with claim 6 wherein said winglet is formed integrally with said airfoil using an electro-chemical machining process.

13. A gas turbine engine comprising a plurality of rotor blades, each said rotor blade comprising an airfoil comprising a leading edge, a trailing edge, a first side wall, a second side wall, and at least one winglet extending outwardly from at least one of said first side wall and said second side wall such that a radius is formed between said winglet and at one of said first and second side walls, said airfoil first and second side walls connected axially at said leading and trailing edges, said first and second side walls extending radially from a blade root to an airfoil tip, said at least one airfoil winglet is positioned a distance from the leading edge and trailing edge and is a radial distance from said airfoil tip.

14. A gas turbine engine in accordance with claim 13 wherein said winglet is formed integrally with said airfoil using an electro-chemical machining process.

15. A gas turbine engine in accordance with claim 13 wherein at least one of said rotor blade airfoil first side wall and said second side wall is concave, at least one of said airfoil first side wall and said second side wall is convex, said at least one airfoil winglet is substantially flush with at least one of said airfoil first and second side walls at said airfoil leading edge.

16. A gas turbine engine in accordance with claim 13 wherein at least one of said rotor blade airfoil first side wall and said second side wall is concave, at least one of said airfoil first side wall and said second side wall is convex, said at least one airfoil winglet is substantially flush with at least one of said airfoil first and second side walls at said airfoil trailing edge.

17. A gas turbine engine in accordance with claim 13 wherein said at least one airfoil winglet facilitates structurally supporting said airfoil such that a natural frequency of torsional or chordwise vibration of the airfoil is increased to a frequency that is not present within said gas turbine engine during engine operations.

18. A gas turbine engine in accordance with claim 13 wherein said at least one airfoil winglet comprises a first winglet extending outwardly from said airfoil first side wall, and a second winglet extending outwardly from said airfoil second side wall.

* * * * *